US010910719B2

(12) United States Patent
Hsieh et al.

(10) Patent No.: US 10,910,719 B2
(45) Date of Patent: Feb. 2, 2021

(54) ANTENNA DEVICE AND ANTENNA SYSTEM

(71) Applicant: AU Optronics Corporation, Hsin-Chu (TW)

(72) Inventors: Yi-Chen Hsieh, Hsin-Chu (TW); Yi-Hsiang Lai, Hsin-Chu (TW); Ching-Huan Lin, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 112 days.

(21) Appl. No.: 16/445,296

(22) Filed: Jun. 19, 2019

(65) Prior Publication Data

US 2020/0243974 A1 Jul. 30, 2020

(30) Foreign Application Priority Data

Jan. 30, 2019 (TW) ..... 108103601 A

(51) Int. Cl.

| | |
|---|---|
| ***H01Q 9/04*** | (2006.01) |
| ***H01Q 1/38*** | (2006.01) |
| ***H01Q 1/48*** | (2006.01) |
| ***H01Q 13/10*** | (2006.01) |

(52) U.S. Cl.

CPC ..... *H01Q 9/045* (2013.01); *H01Q 1/38* (2013.01); *H01Q 1/48* (2013.01); *H01Q 13/10* (2013.01)

(58) Field of Classification Search

CPC .. H01Q 9/04; H01Q 1/38; H01Q 1/48; H01Q 13/10

USPC ..... 343/700 R

See application file for complete search history.

(56) References Cited

U.S. PATENT DOCUMENTS

| | | | | |
|---|---|---|---|---|
| 6,501,427 | B1 | 12/2002 | Lilly et al. | |
| 2010/0090903 | A1 | 4/2010 | Byun et al. | |
| 2012/0007781 | A1* | 1/2012 | Kim | H01Q 1/2283 343/700 MS |
| 2012/0274523 | A1* | 11/2012 | Ayatollahi | H01Q 13/10 343/745 |
| 2012/0274527 | A1* | 11/2012 | Ayatollahi | H01Q 1/38 343/770 |
| 2017/0170572 | A1 | 6/2017 | Severson et al. | |

* cited by examiner

*Primary Examiner* — Andrea Lindgren Baltzell
(74) *Attorney, Agent, or Firm* — WPAT, PC

(57) ABSTRACT

An antenna device includes a first substrate, a first radiation part, a first grounding part, a second radiation part, a liquid crystal layer, and a feeding line. The first substrate includes a first surface and a second surface. The first radiation part is formed on the first surface. The first grounding part includes a slot, and the first radiation part is formed in a projection of the slot projected onto the first surface. The second radiation part is formed in the slot, and coupled with the first grounding part through a conductive segment. The liquid crystal layer is disposed between the first radiation part and the second radiation part. The feeding line is formed on the second surface, and a projection of the first radiation part projected onto the second surface is at least partially overlapping with the feeding line.

19 Claims, 11 Drawing Sheets

ANTENNA DEVICE AND ANTENNA SYSTEM

CROSS-REFERENCE TO RELATED APPLICATION

This application claims priority to Taiwan Application Serial Number 108103601, filed Jan. 30, 2019, which is herein incorporated by reference in its entirety.

BACKGROUND

Field of Invention

The present disclosure relates to an antenna device and an antenna system. More particularly, the present disclosure relates to an antenna device includes a liquid crystal layer to adjust the resonant frequency.

Description of Related Art

There are many situations in today's daily life that require the use of directional antennas to accurately align the beams produced by the antennas to the target. For example, a non-contact biomedical sensing system needs to align the beam with the subject; remote wireless charging requires the beam to be aligned with the device being charged; the traveling radar needs to align the beam with the direction of travel; and an unmanned aerial vehicle (UAV) is required to align the beam with the target being tracked and so on. Conventional directional antennas, i.e., dish antennas, and their motors and transmission devices, however, are difficult to meet the requirements of the above-mentioned situations for light weight, miniaturization, and low power consumption.

SUMMARY

The disclosure provides an antenna device including a first substrate, a first radiation part, a first grounding part, a second radiation part, a liquid crystal layer, and a feeding line. The first substrate includes a first surface and a second surface. The first radiation part is formed on the first surface. The first grounding part includes a slot, and the first radiation part is formed in a projection of the slot projected onto the first surface. The second radiation part is formed in the slot, and coupled with the first grounding part through a conductive segment. The liquid crystal layer is disposed between the first radiation part and the second radiation part. The feeding line is formed on the second surface, and a projection of the first radiation part projected onto the second surface is at least partially overlapping with the feeding line.

The disclosure provides an antenna system including a control circuit and a plurality of antenna devices. Each of the plurality of antenna devices includes a first substrate, a first radiation part, a first grounding part, a second radiation part, a liquid crystal layer, and a feeding line. The first substrate includes a first surface and a second surface. The first radiation part is formed on the first surface. The first grounding part includes a slot, and the first radiation part is formed in a projection of the slot projected onto the first surface. The second radiation part is formed in the slot, and coupled with the first grounding part through a conductive segment. The liquid crystal layer is disposed between the first radiation part and the second radiation part. The feeding line is formed on the second surface, and a projection of the first radiation part projected onto the second surface is at least partially overlapping with the feeding line. The feeding lines of each of the plurality of antenna devices are mutually coupled, and the control circuit is configured to control a voltage difference between the first radiation part and the second radiation part of each of the plurality of antenna devices.

It is to be understood that both the foregoing general description and the following detailed description are by examples, and are intended to provide further explanation of the disclosure as claimed.

DETAILED DESCRIPTION

Figure 1:
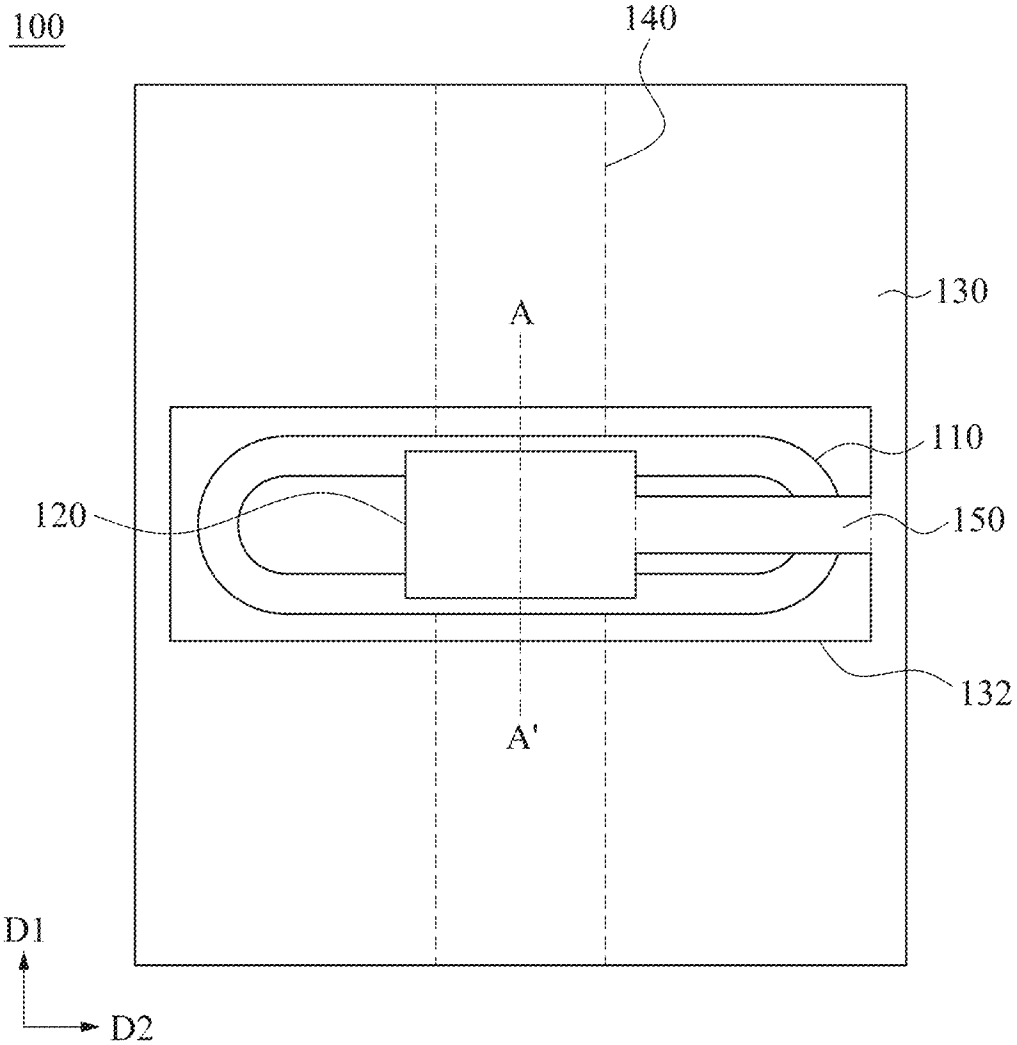
FIG. 1 is a simplified top view diagram of an antenna device according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

Figure 2:
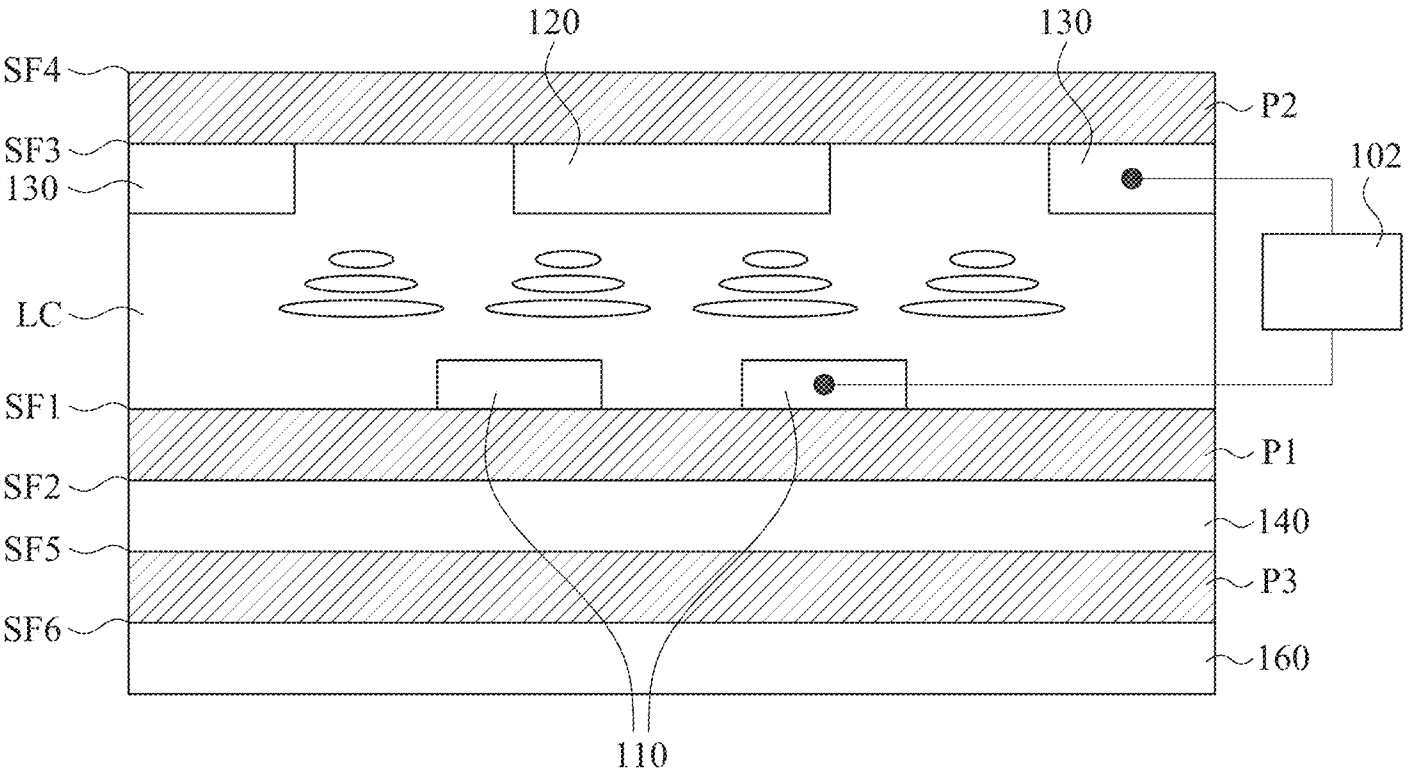
FIG. 2 is a simplified cross-sectional diagram of the antenna device of FIG. 1 along the direction A-A'.

FIG. 1 is a simplified top view diagram of an antenna device 100 according to one embodiment of the present disclosure. FIG. 2 is a simplified cross-sectional diagram of the antenna device 100 of FIG. 1 along the direction A-A'. Reference is made to FIGS. 1 and 2, the antenna device 100 comprises a first radiation part 110, a second radiation part 120, a first grounding part 130, a feeding line 140, a conductive segment 150, a second grounding part 160, a first substrate P1, a second substrate P2, a third substrate P3, and a liquid crystal layer LC.

The first substrate P1 comprises a first surface SF1 and a second surface SF2, and the second substrate P2 comprises a third surface SF3 and a fourth surface SF4. The first radiation part 110 is formed on the first surface SF1, and the second radiation part 120, the first grounding part 130, and the conductive segment 150 are formed on the third surface SF3. The first grounding part 130 comprises a slot 132, where the slot 132 is configured to expose the first radiation part 110 so that the radiation field of the first radiation part 110 would not be shielded by the first grounding part 130. As a result, the radiation efficiency of the antenna device 100 is increased. The second radiation part 120 is formed in the slot 132, and coupled with the first grounding part 130 through the conductive segment 150. The liquid crystal layer LC is filled between the first substrate P1 and the second substrate P2, that is, between the first surface SF1 and the third surface SF3.

The third substrate P3 comprises a fifth surface SF5 and a sixth surface SF6. The feeding line 140 is formed between the second surface SF2 and the fifth surface SF5, and the second grounding part 160 is formed on the sixth surface SF6. In this embodiment, the feeding line 140 is formed as extending along the first direction D1, and the slot 132 is formed as extending along the second direction D2. In one embodiment, the first direction D1 is orthogonal to the second direction D2.

In practice, the first substrate P1, the second substrate P2, and the third substrate P3 may be glass substrates. In one embodiment, the liquid crystal layer LC may be coupled with the first radiation part 110, the second radiation part 120, the first grounding part 130, the first surface SF1, and the third surface SF3, through a passivation layer and/or an orientation layer.

The first radiation part 110, the second radiation part 120, and a portion of liquid crystal layer LC between and around the first radiation part 110 and the second radiation part 120 together form an equivalent capacitor. The first radiation part 110 and the first grounding part 130 are coupled with a control circuit 102. The control circuit 102 is configured to provide voltages to the first radiation part 110 and the first grounding part 130, so as to control a voltage difference between the first radiation part 110 and the second radiation part 120. As a result, the rotation angle of liquid crystal between and around the first radiation part 110 and second radiation part 120 can be controlled, and capacitance of the aforementioned equivalent capacitor can be adjusted in order to switch the antenna device 100 between an enabling status and a disabling status.

In one embodiment, the antenna device 100 comprises a plurality of conductive segments 150, and the second radiation part 120 is coupled with the first grounding part 130 through the plurality of conductive segments 150.

Figure 3:
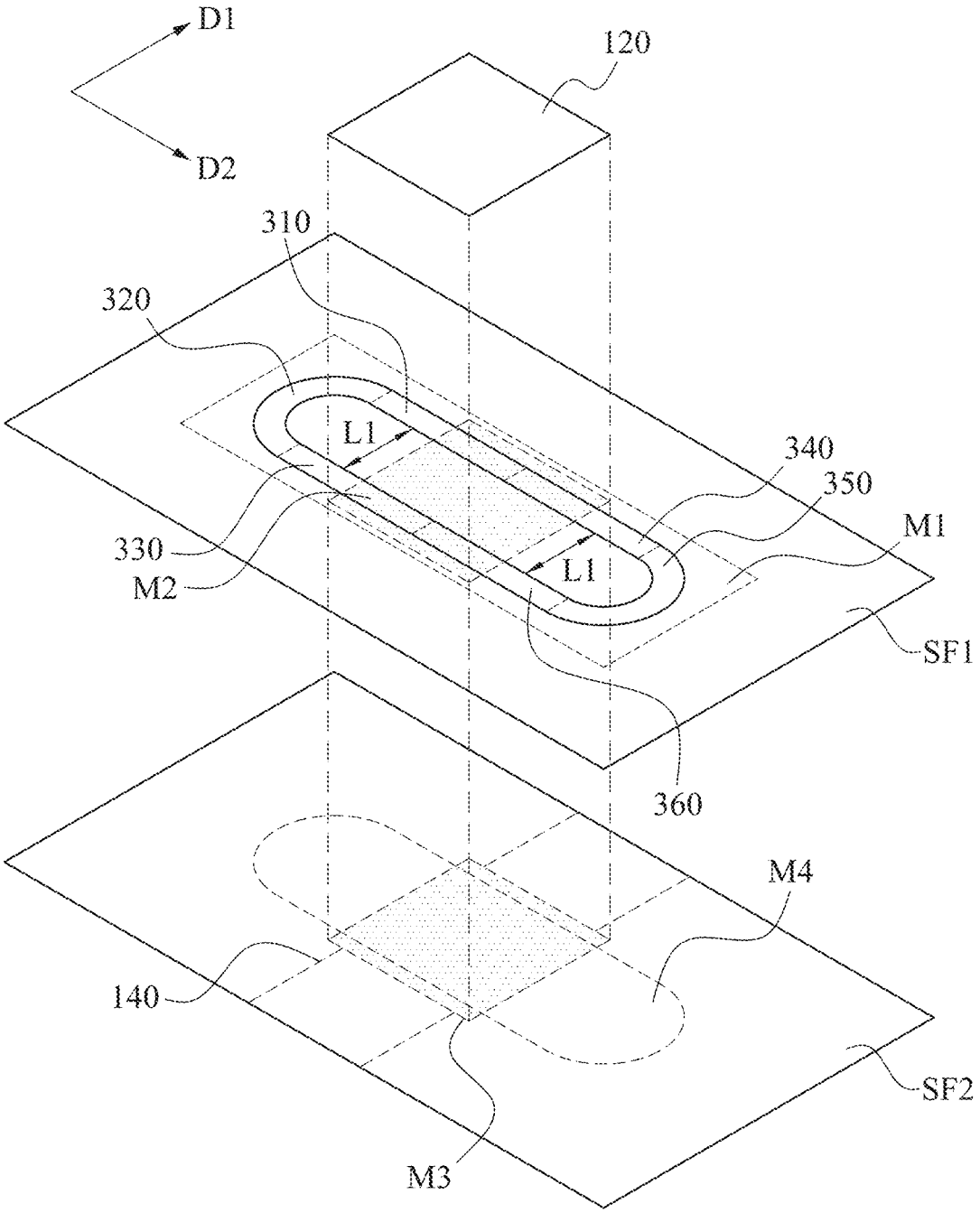
FIG. 3 is a schematic diagram for illustrating the relative positions of the first radiation part, the second radiation part, and the feeding line of FIG. 2.

FIG. 3 is a schematic diagram for illustrating relative positions of the first radiation part 110, the second radiation part 120, and the feeding line 140 of FIG. 2. The first radiation part 110 comprises a first radiation segment 310, a second radiation segment 320, a third radiation segment 330, a fourth radiation segment 340, a fifth radiation segment 350, and a sixth radiation segment 360. The first radiation segment 310, the third radiation segment 330, the fourth radiation segment 340, and the sixth radiation segment 360 are parallel with each other, and are formed as extending along the second direction D2.

Two terminals of the second radiation segment 320 are coupled with the first radiation segment 310 and the third radiation segment 330, respectively, to form a U-shaped structure. Two terminals of the fifth radiation segment 350 are coupled with the fourth radiation segment 340 and the sixth radiation segment 360, respectively, to form another U-shaped structure. The two U-shaped structures are coupled with each other in a manner that the openings of the two U-shaped structures are mutually opposite, that is, the first radiation segment 310 is coupled with the fourth radiation segment 340, and the third radiation segment 330 is coupled with the sixth radiation segment 360. In addition, the first radiation segment 310 and the third radiation segment 330 are spaced apart by a predetermined distance L1 on the second direction D2, and the fourth radiation segment 340 and the sixth radiation segment 360 are also spaced apart by the predetermined distance L1 on the second direction D2.

In other words, the first radiation part 110 is a ring or a rectangle having a hollow area. In practice, the first radiation part 110 has a width of 0.5-0.8 mm on the first direction D1, and has a length of 2-4 mm on the second direction D2. The second radiation part 120 has a width of 0.2-0.6 mm on the first direction D1, and has a length of 0.4-0.7 mm on the second direction D2.

As shown in FIG. 3, the first radiation part 110 is located in a projection M1 of the slot 132 projected onto the first surface SF1. Therefore, the first radiation part 110 may be completely exposed by the slot 132, and would not be shielded by the first grounding part 130. In addition, a projection M2 of the second radiation part 120 projected onto the first surface SF1 is at least partially overlapping with the first radiation segment 310, third radiation segment 330, fourth radiation segment 340, and the sixth radiation segment 360. A projection M3 of the second radiation part 120 projected onto the second surface SF2 is at least partially overlapping with the feeding line 140. Furthermore, a projection M4 of the first radiation part 110 projected onto the second surface SF2 is at least partially overlapping with the feeding line 140.

In the foregoing embodiments, the second radiation part 120 is merely an exemplary illustration. The size, position, and shape of the second radiation part 120 can be adjusted according to different design considerations. For example, the shape of the second radiation part 120 can be rectangular, circular, or other shape satisfying design requirements.

The first grounding part 130, the second grounding part 160, and the feeding line 140 together form a radio frequency (RF) signal transmission structure, the RF signal transmission structure is configured to provide RF signals to the first radiation part 110 and the second radiation part 120. FIG. 4A is a schematic diagram for illustrating equivalent current paths of the antenna device 100. When the RF signal transmission structure provides the RF signals, a first equivalent current path 410 and a second equivalent current path 420 are formed on the first radiation part 110, while a third equivalent current path 430 and a fourth equivalent current path 440 are formed on the second radiation part 120. The first equivalent current path 410 starts from the first radiation segment 310 and ends at the third radiation segment 330 via the second radiation segment 320. The second equivalent current path 420 starts from the fourth radiation segment 340 and ends at the sixth radiation segment 360 via the fifth radiation segment 350.

In one embodiment, when the RF signal has a specific signal phase and is transmitted from the bottom side to the top side of the antenna device 100, the first equivalent current path 410 and the third equivalent current path 430 have a counterclockwise current direction, while the second equivalent current path 420 and the fourth equivalent current path 440 have a clockwise current direction. When the RF signal has other signal phase, the first equivalent current path 410 and the third equivalent current path 430 have the clockwise current direction, while the second equivalent current path 420 and the fourth equivalent current path 440 have the counterclockwise current direction.

Figure 4B:
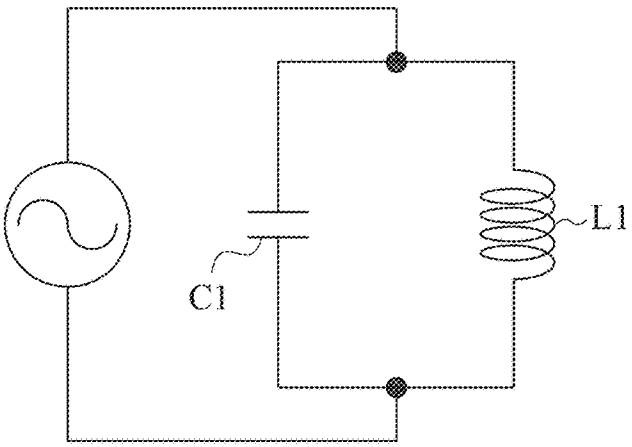
FIG. 4B is a schematic diagram of an equivalent circuit of the antenna device of FIG. 1 according to one embodiment of the present disclosure.
Figure 4A:
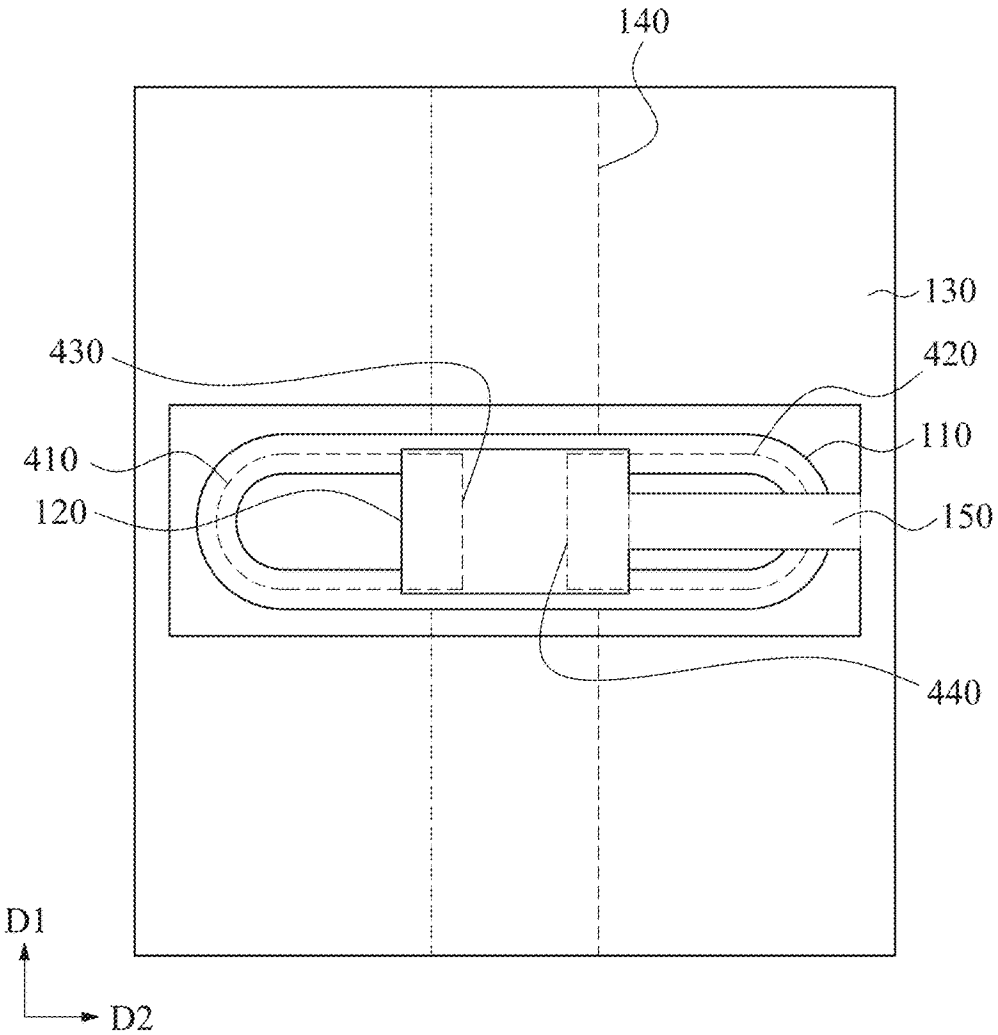
FIG. 4A is a schematic diagram for illustrating equivalent current paths of the antenna device of FIG. 1.

In addition, when the feeding line 140 provides the RF signals, the antenna device 100 has an equivalent circuit shown in FIG. 4B. In the equivalent circuit of FIG. 4B, the capacitance of the capacitor C1 is positively correlated with the area of the first radiation part 110. Specifically, the capacitance of the capacitor C1 is positively correlated with an overlapping area of the projection M2 of the second radiation part 120 and the first radiation part 110, and also positively correlated with an area derived from the fringing field. The capacitance of the capacitor C1 is further positively correlated with the dielectric constant of the liquid crystal between and around the first radiation part 110 and the second radiation part 120. The inductance of the inductor L1 is positively correlated with a sum of lengths of the first radiation segment 310, the second radiation segment 320, the third radiation segment 330, the fourth radiation segment 340, the fifth radiation segment 350, and the sixth radiation segment 360, and also positively correlated with an equivalent length of the second radiation part 120 on the first direction D1.

A resonant frequency of the antenna device 100 can be calculated by Formula 1:

$$f = \frac{1}{2\pi\sqrt{LC}}, \qquad \text{(Formula 1)}$$

where f is the resonant frequency of the antenna device 100, C is the equivalent capacitance of the capacitor C1, and L is the equivalent inductance of the inductor L1. Therefore, the resonant frequency of the antenna device 100 is negatively correlated with the sum of lengths of the first radiation segment 310, the second radiation segment 320, the third radiation segment 330, the fourth radiation segment 340, the fifth radiation segment 350, and the sixth radiation segment 360, and also negatively correlated with the equivalent length of the second radiation part 120 on the first direction D1. The resonant frequency of the antenna device 100 is further negatively correlated with the overlapping area of the second radiation part 120 and the first radiation part 110, and further negatively correlated with the sum of area derived from the fringing field.

Figure 5:
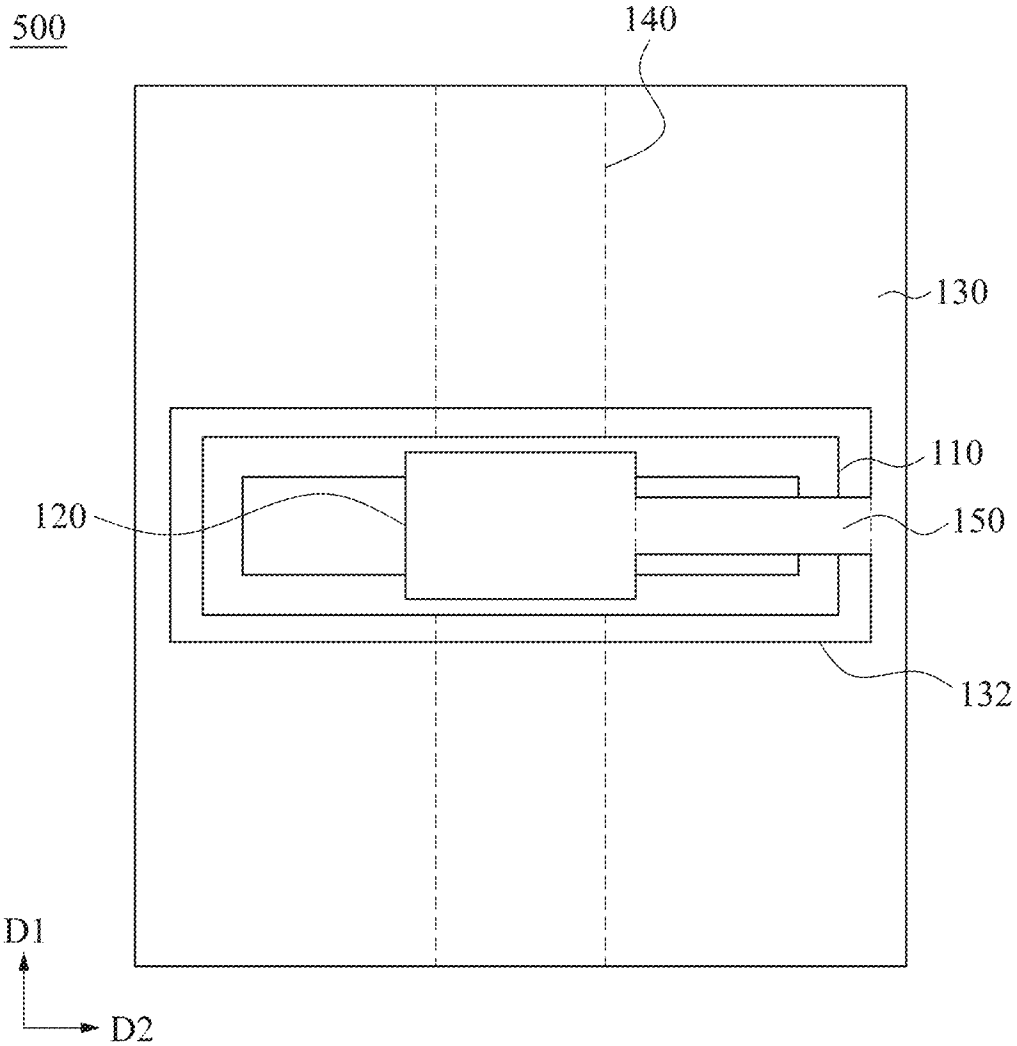
FIG. 5 is a simplified top view diagram of an antenna device according to another embodiment of the present disclosure.

FIG. 5 is a simplified top view diagram of an antenna device 500 according to one embodiment of the present disclosure. The antenna device 500 is similar to the antenna device 100 of FIG. 1, and the difference is that the first radiation part 110 of the antenna device 500 is a hollow rectangle. The foregoing descriptions regarding the implementations, connections, operations, and related advantages of other corresponding components in the antenna device 100 are also applicable to the antenna device 500. For the sake of brevity, those descriptions will not be repeated here.

Figure 6:
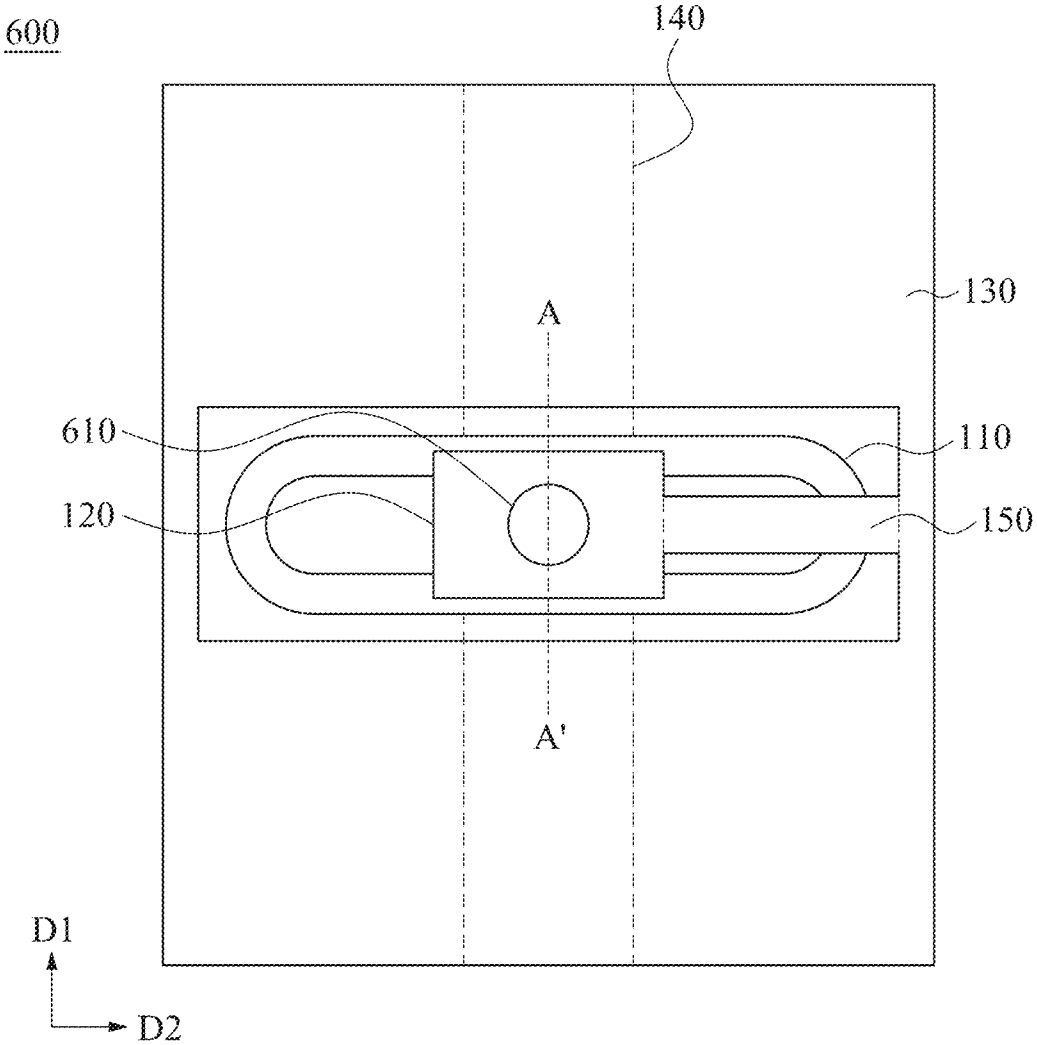
FIG. 6 is a simplified top view diagram of an antenna device according to yet another embodiment of the present disclosure.
Figure 7:
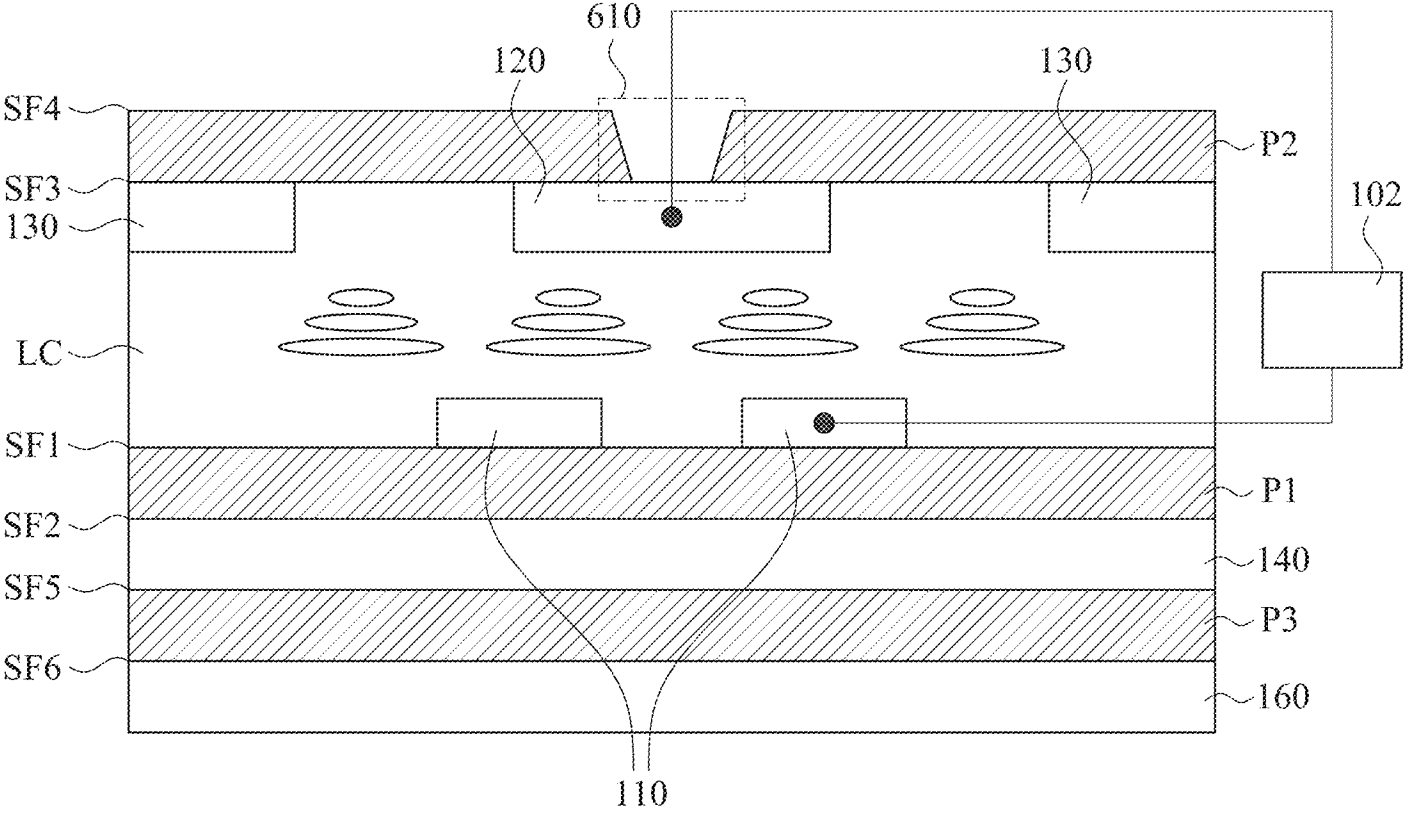
FIG. 7 is a simplified cross-sectional diagram of the antenna device of FIG. 6 along the direction A-A'.

FIG. 6 is a simplified top view diagram of an antenna device 600 according to one embodiment of the present disclosure. FIG. 7 is a simplified cross-sectional diagram of the antenna device 600 of FIG. 6 along the direction A-A'. The antenna device 600 is similar to the antenna device 100, and the different is that the antenna device 600 further comprises a via hole 610. Reference is made to FIG. 7, the via hole 610 passes through the first substrate P1 to expose part of the second radiation part 120, and the via hole 610 is formed between the second radiation part 120 and the fourth surface SF4.

In this embodiment, the control circuit 102 is coupled with the first radiation part 110, and is coupled with the second radiation part 120 through the via hole 610. Therefore, the control circuit 102 may provide voltages directly to the second radiation part 120, and needs not to provide voltages indirectly to the second radiation part 120 via the first grounding part 130. As a result, the rotation angle of the liquid crystal between and around the first radiation part 110 and the second radiation part 120 can be controlled more precisely.

The foregoing descriptions regarding the implementations, connections, operations, and related advantages of other corresponding components in the antenna device 100 are also applicable to the antenna device 600. For the sake of brevity, those descriptions will not be repeated here.

In some embodiments, the second grounding part 160 of the antenna devices 100 and 600 may be omitted, so as to reduce process steps and production costs. In the situation that the second grounding part 160 is omitted, the radiation fields generated by the antenna devices 100 and 600 are prevented from being disturbed by a voltage difference possibly generated between the first grounding part 130 and the second grounding part 160. When the second grounding part 160 is omitted, the RF signal transmission structure is formed by the first grounding part 130 and the feeding line 140.

Figure 8:
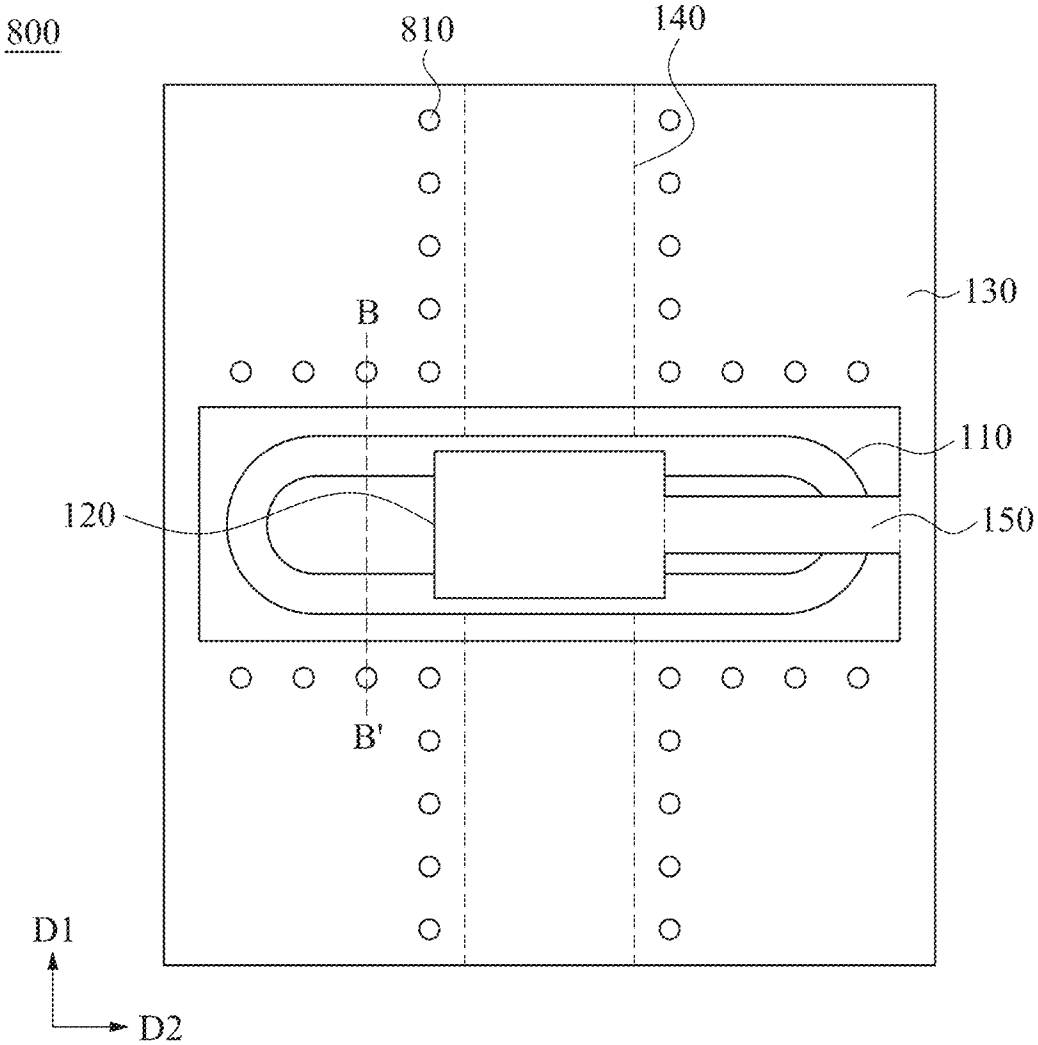
FIG. 8 is a simplified top view diagram of an antenna device according to yet another embodiment of the present disclosure.
Figure 9:
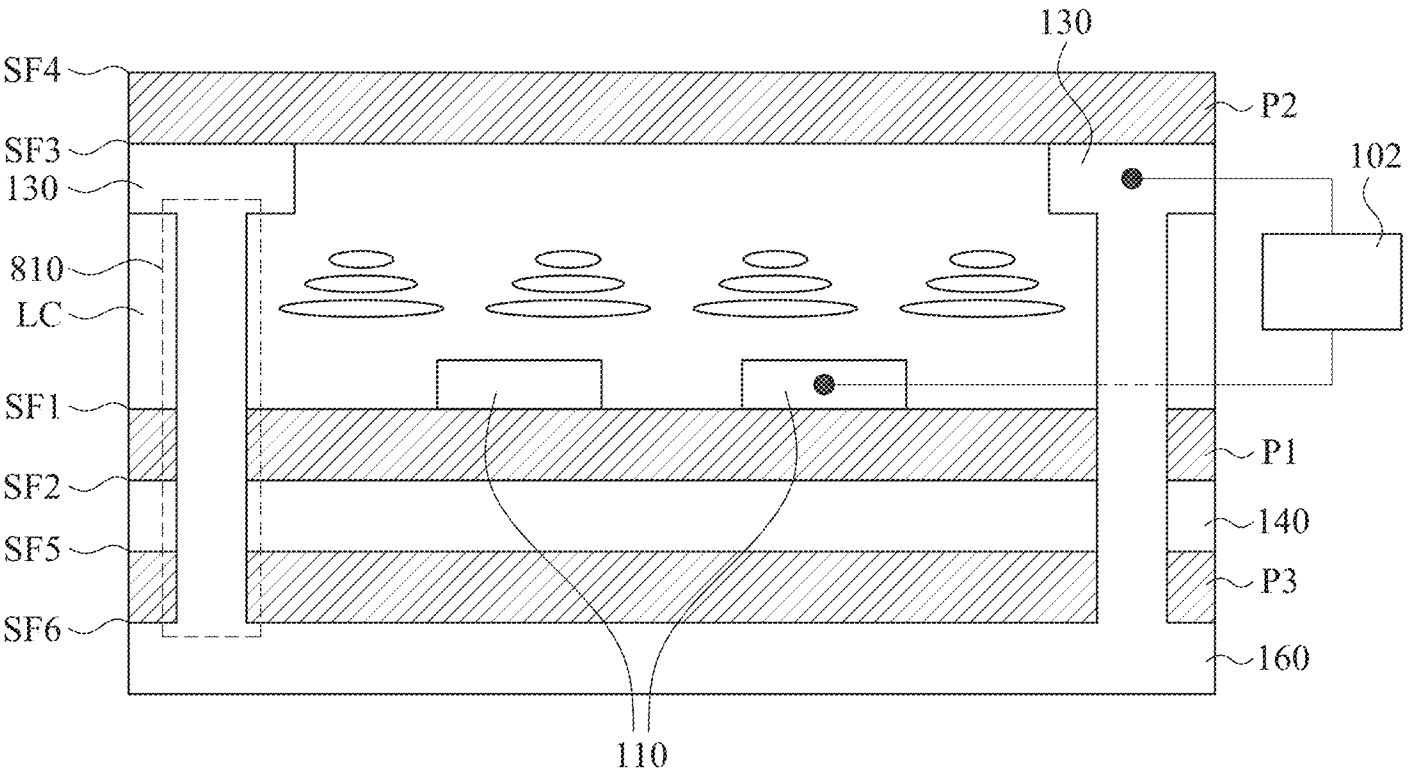
FIG. 9 is a simplified cross-sectional diagram of the antenna device of FIG. 8 along the direction B-B'.

FIG. 8 is a simplified top view diagram of an antenna device 800 according to one embodiment of the present disclosure. FIG. 9 is a simplified cross-sectional diagram of the antenna device 800 of FIG. 8 along the direction B-B'. The antenna device 800 is similar to the antenna device 100, and the difference is that the antenna device 800 further comprises a plurality of via holes 810. Reference is made to FIG. 8, some of the via holes 810 are arranged along the first direction D1, and are formed adjacent to the feeding line 140. Other via holes 810 are arranged along the second direction D2, and are formed adjacent to the slots 132, but the arrangement of the via holes 810 are not limited thereto. The via holes 810 may be arranged in other manners satisfying the design requirements.

Reference is made to FIG. 9, the via hole 810 passes through the liquid crystal layer LC, the first substrate P1, and the third substrate P3, and the first grounding part 130 is coupled with the second grounding part 160 through the via hole 810. As a result, the first grounding part 130 and the second grounding part 160 would have the same voltage level, and the radiation field generated by the antenna device 800 is prevented from being disturbed by a voltage difference possibly generated between the first grounding part 130 and the second grounding part 160.

The foregoing descriptions regarding the implementations, connections, operations, and related advantages of other corresponding components in the antenna device 100 are also applicable to the antenna device 800. For the sake of brevity, those descriptions will not be repeated here.

Figure 10:
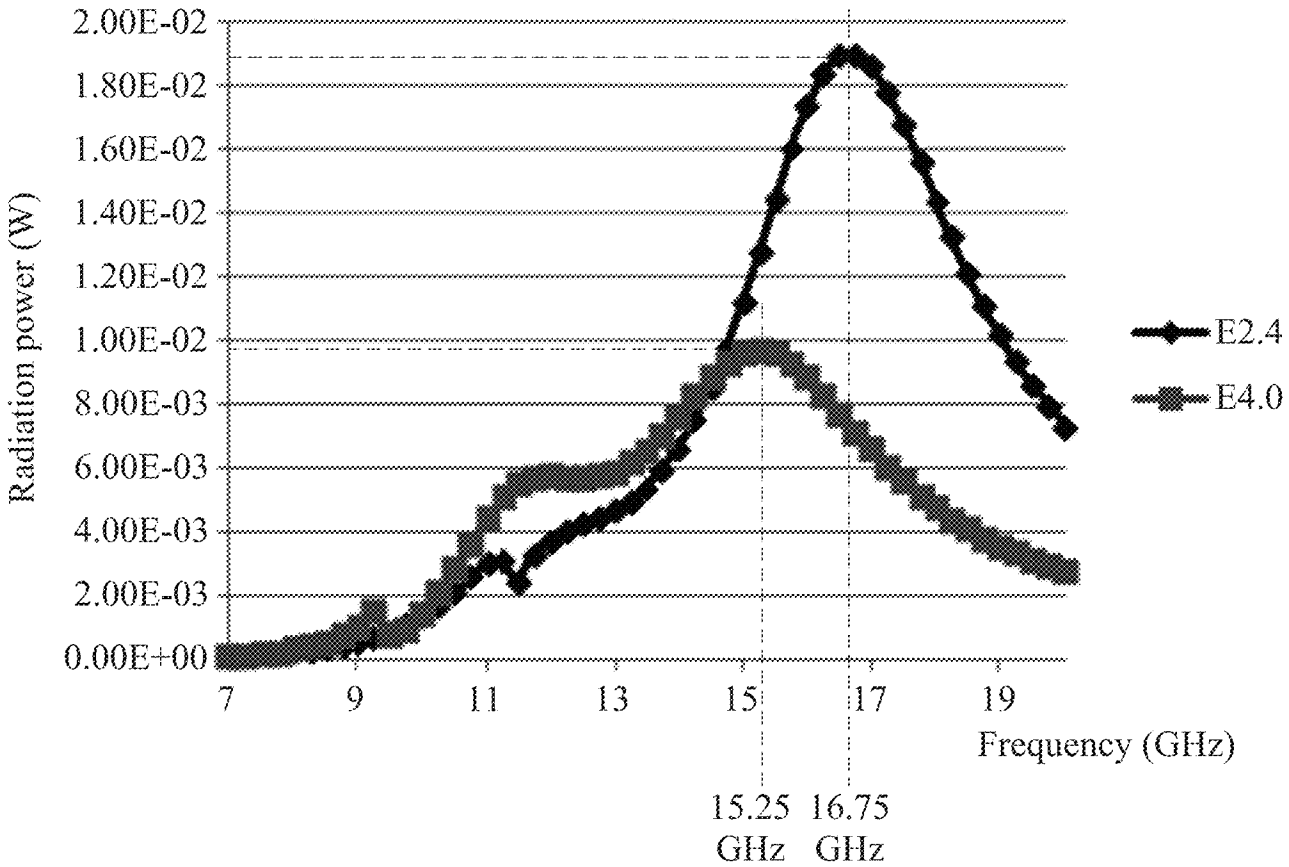
FIG. 10 is a schematic diagram for illustrating characteristics of the antenna device of FIG. 1 for two voltage differences between the first radiation part and the second radiation part.

FIG. 10 is a schematic diagram for illustrating characteristics of the antenna device 100 for two voltage differences between the first radiation part 110 and the second radiation part 120. Curve Q1 is the radiation power of the antenna device 100 for different working frequencies, while the voltage difference between the first radiation part 110 and the second radiation part 120 is 0 V so that the liquid crystal has a first dielectric constant, e.g., 4.0. As can be appreciated from curve Q1, when the liquid crystal has the first dielectric constant, the resonant frequency of the antenna device 100 is approximately 16.75 GHz. That is, the antenna device 100 generates a radiation field having a higher energy when operated in a frequency around near 16.75 GHz, and generates a radiation field having a lower energy when operated in other frequency bands.

The curve Q2 is the radiation power of the antenna device 100 for different working frequencies, while the voltage difference between the first radiation part 110 and the second radiation part 120 is 5 V so that the liquid crystal has a second dielectric constant, e.g., 2.4. The first dielectric constant is larger than the second dielectric constant. As can be appreciated from the curve Q2, when the liquid crystal has the second dielectric constant, the resonant frequency of the antenna device 100 is approximately 15.25 GHz. That is, the antenna device 100 generates a radiation field having a higher energy when operated in a frequency band around 15.25 GHz, and generates a radiation field having a lower energy when operated in other frequency bands.

When the antenna device 100 is fixed to be operated in a frequency band around 16.75 GHz, the radiation power of curve Q1 is larger than that of curve Q2 for at least an order of magnitude. As a result, the antenna device 100 is capable of being switched between operation statuses.

For example, in an embodiment that the antenna device 100 is operated in the frequency band of 16.75 GHz, when the voltage difference between the first radiation part 110 and the second radiation part 120 is 0 V so that the liquid crystal has a dielectric constant of 4.0, the antenna device 100 is operated at the enabling status. In another embodiment that the antenna device 100 remains in the frequency band of 16.75 GHz, when the voltage difference between the first radiation part 110 and the second radiation part 120 is 5V so that the liquid crystal has a dielectric constant of 2.4, the antenna device 100 is operated at the disabling status.

In one embodiment, the antenna device 100 has the liquid crystal having the first dielectric constant smaller than the second dielectric constant. When the antenna device 100 is fixed to be operated in the frequency band around 16.75 GHz and the voltage difference between the first radiation part 110 and the second radiation part 120 is 0 V, the antenna device 100 is operated at the disabling status. On the other hand, when the voltage difference between the first radiation part 110 and the second radiation part 120 is 5 V, the antenna device 100 is operated at the enabling status.

As can be appreciated from the foregoing descriptions, the antenna devices 100, 600, and 800 are compatible with the mature process of flat panel display, and thus having advantages such as easy to manufacture and thin size. In addition, the voltage difference, for switching the antenna devices 100, 600, and 800 between the operation statuses, is significantly small, and thus the power consumption is small.

Furthermore, the resonant frequencies of the antenna devices 100, 600, and 800 can be determined by various parameters, such as the length of the first radiation part 110, the area of the second radiation part 120, the dielectric constant of the liquid crystal, etc. Therefore, the antenna devices 100, 600, 800 have a high degree of design freedom.

Figure 11:
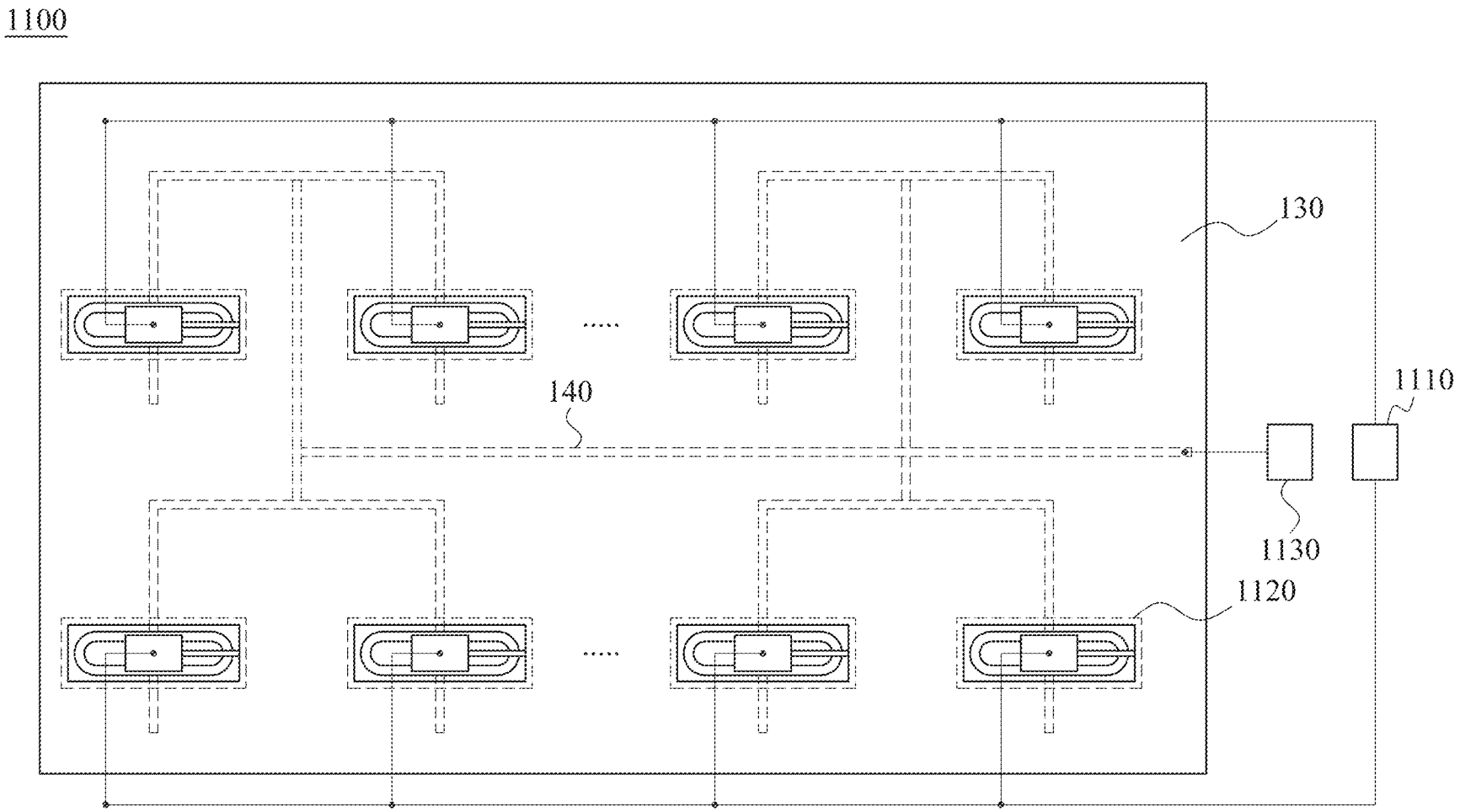
FIG. 11 is a simplified functional diagram of an antenna system according to one embodiment of the present disclosure.

FIG. 11 is a simplified functional diagram of an antenna system 1100 according to one embodiment of the present disclosure. The antenna system 1100 comprises a control circuit 1110, a plurality of antenna devices 1120, and a RF signal generation circuit 1130. Each of the antenna devices 1120 may be realized by the aforementioned antenna device 100, 600, or 800, and the antenna devices 1120 are arranged as a matrix. In this embodiment, the feeding lines 140 of each of the antenna devices 1120 are coupled with each other, so as to commonly receive the RF signal from the RF signal generation circuit 1130. In addition, the control circuit 1110 is configured to control the voltage difference between the first radiation part 110 and the second radiation part 120 for the plurality of antenna devices 1120, respectively.

In other words, the control circuit 1110 can control the individual antenna devices 1120 to operate in the enabling status or the disabling status. As a result, the antenna system 1100 can realize the holographic beam steering, so as to generate a directional beam having a flexibly controlled radiation angle.

Accordingly, the antenna system 1100 has advantages such as thin size and low power consumption, and can be manufactured as a size that is easy to carry as the small and medium size flat panel display. Therefore, the antenna system 1100 can be applied to the field of traveling radar, unmanned aerial vehicle radar, remote wireless charging, and non-contact biomedical sensing system, etc., which need to align the beam of the antenna with the target.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

The term "and/or" may comprise any and all combinations of one or more of the associated listed items. In addition, the singular forms "a," "an," and "the" herein are intended to comprise the plural forms as well, unless the context clearly indicates otherwise.

Throughout the description and claims, it will be understood that when a component is referred to as being "positioned on," "positioned above," "connected to," "engaged with," or "coupled with" another component, it can be directly on, directly connected to, or directly engaged with the other component, or intervening component may be present. In contrast, when a component is referred to as being "directly on," "directly connected to," or "directly engaged with" another component, there are no intervening components present.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An antenna device, comprising:

a first substrate, comprising a first surface and a second surface;

a first radiation part, formed on the first surface;

a first grounding part, comprising a slot, wherein the first radiation part is formed in a projection of the slot projected onto the first surface;

a second radiation part, formed in the slot, and coupled with the first grounding part through a conductive segment;

a liquid crystal layer, disposed between the first radiation part and the second radiation part; and a feeding line, formed on the second surface, wherein a projection of the first radiation part projected onto the second surface is at least partially overlapping with the feeding line.

2. The antenna device of claim 1, wherein the first grounding part and the feeding line together form a radio frequency (RF) signal transmission structure, and the RF signal transmission structure is configured to transmit a RF signal to the first radiation part and the second radiation part.

3. The antenna device of claim 1, further comprising:

a second substrate, comprising a third surface, wherein the first grounding part and the second radiation part are formed on the third surface, and the liquid crystal layer is disposed between the first surface and the third surface.

4. The antenna device of claim 3, wherein the second substrate comprises:

a fourth surface, opposite to the third surface; and a via hole, passing through the second substrate, and formed between the second radiation part and the fourth surface.

5. The antenna device of claim 3, further comprising:

a third substrate, comprising a fifth surface and a sixth surface, wherein the feeding line is formed between the second surface and the fifth surface; and a second grounding part, formed on the sixth surface.

6. The antenna device of claim 5, further comprising a plurality of via holes, wherein the plurality of via holes pass through the liquid crystal layer, the first substrate, and the third substrate, and the first grounding part coupled with the second grounding part through the plurality of via holes.

7. The antenna device of claim 5, wherein the first grounding part, the second grounding part, and the feeding line together form a RF signal transmission structure, and the RF signal transmission structure is configured to transmit a RF signal to the first radiation part and the second radiation part.

8. The antenna device of claim 1, wherein the first radiation part is a ring or a hollow rectangle.

9. The antenna device of claim 8, wherein a projection of the second radiation part projected onto the first surface is at least partially overlapping with the first radiation part, and a projection of the second radiation part projected onto the second surface is at least partially overlapping with the feeding line.

10. The antenna device of claim 8, wherein the first radiation part comprises a first radiation segment, a second radiation segment, a third radiation segment, a fourth radiation segment, a fifth radiation segment, and a sixth radiation segment, wherein two terminals of the second radiation segment are respectively coupled with the first radiation segment and the third radiation segment, two terminals of the fifth radiation segment are respectively coupled with the fourth radiation segment and the sixth radiation segment, the first radiation segment is coupled with the fourth radiation segment, and the third radiation segment is coupled with the sixth radiation segment, wherein the first radiation segment, the third radiation segment, the fourth radiation segment, and the sixth radiation segment is formed as extending along a first direction, the first radiation segment and the third radiation segment are spaced apart by a predetermined distance on a second direction, the fourth radiation segment and the sixth radiation segment are spaced apart by the predetermined distance on the second direction, and the first direction is orthogonal to the second direction.

11. The antenna device of claim 10, wherein a resonance frequency of the antenna device is negatively correlated with a sum of lengths of the first radiation segment, the second radiation segment, the third radiation segment, the fourth radiation segment, the fifth radiation segment, and the sixth radiation segment, or negatively correlated with an area of the second radiation part.

12. An antenna system, comprising:

a control circuit; and a plurality of antenna devices, wherein each of the plurality of antenna devices comprises:

a first substrate, comprising a first surface and a second surface;

a first radiation part, formed on the first surface;

a first grounding part, comprising a slot, wherein the first radiation part is formed in a projection of the slot projected onto the first surface;

a second radiation part, formed in the slot, and coupled with the first grounding part through a conductive segment;

a liquid crystal layer, disposed between the first radiation part and the second radiation part; and a feeding line, formed on the second surface, wherein a projection of the first radiation part projected onto the second surface is at least partially overlapping with the feeding line, wherein the feeding lines of each of the plurality of antenna devices are mutually coupled, and the control circuit is configured to control a voltage difference between the first radiation part and the second radiation part of each of the plurality of antenna devices.

13. The antenna system of claim 12, wherein the first grounding part and the feeding line together form a RF signal transmission structure, the RF signal transmission structure is configured to transmit a RF signal to the first radiation part and the second radiation part.

14. The antenna system of claim 12, further comprising:

a second substrate, comprising a third surface, wherein the first grounding part and the second radiation part are formed on the third surface, and the liquid crystal layer is disposed between the first surface and the third surface.

15. The antenna system of claim 14, wherein the second substrate comprises:

a fourth surface, opposite to the third surface; and a via hole, passing through the second substrate, and formed between the second radiation part and the fourth surface.

16. The antenna system of claim 14, further comprising:

a third substrate, comprising a fifth surface and a sixth surface, wherein the feeding line is formed between the second surface and the fifth surface; and a second grounding part, formed on the sixth surface.

17. The antenna system of claim 16, further comprising a plurality of via holes, wherein the plurality of via holes pass through the liquid crystal layer, the first substrate, and the third substrate, and the first grounding part is coupled with the second grounding part through the plurality of via holes.

18. The antenna system of claim 16, wherein the first grounding part, the second grounding part, and the feeding line together form a RF signal transmission structure, the RF signal transmission structure is configured to transmit a RF signal to the first radiation part and the second radiation part.

19. The antenna system of claim 12, wherein the first radiation part is a ring or a hollow rectangle.

* * * * *